United States Patent [19]

Nagata et al.

[11] Patent Number: 4,913,634

[45] Date of Patent: Apr. 3, 1990

[54] SCREW COMPRESSOR WITH SLIDE VALVE MOVEMENT PREVENTING STRUCTURE

[75] Inventors: Kimio Nagata; Shigekazu Nozawa; Minetoshi Izushi, all of Shimizu, Japan

[73] Assignee: Hitachi, Ltd., Tokyo, Japan

[21] Appl. No.: 224,236

[22] Filed: Jul. 25, 1988

Related U.S. Application Data

[63] Continuation of Ser. No. 68,409, Jul. 1, 1987, abandoned.

[30] Foreign Application Priority Data

Jul. 1, 1986 [JP] Japan ..... 61-152657

[51] Int. Cl.[4] ..... F04C 18/16; F04C 29/08

[52] U.S. Cl. ..... 418/47; 418/201; 418/DIG. 1

[58] Field of Search ..... 418/201 R, 201 A, 159, 418/DIG. 1, 47; 417/310

[56] References Cited

U.S. PATENT DOCUMENTS

| | | | |
|---|---|---|---|
| Re. 29,283 | 6/1977 | Shaw | 417/310 |
| 3,088,659 | 5/1963 | Nilsson et al. | 418/201 |
| 3,796,526 | 3/1974 | Cawley | 418/201 |
| 3,904,322 | 9/1975 | Axelsson | 418/201 |
| 4,388,048 | 6/1983 | Shaw et al. | 417/310 |
| 4,478,054 | 10/1984 | Shaw et al. | 418/201 |

FOREIGN PATENT DOCUMENTS

| | | | |
|---|---|---|---|
| 177234 | 4/1986 | European Pat. Off. . | |
| 3505919 | 9/1985 | Fed. Rep. of Germany . | |
| 1258650 | 3/1961 | France . | |
| 0119113 | 9/1979 | Japan | 418/201 |
| 57-195890 | 12/1982 | Japan . | |
| 0119397 | 6/1985 | Japan | 418/201 |

*Primary Examiner*—John J. Vrablik

*Attorney, Agent, or Firm*—Antonelli, Terry & Wands

[57] ABSTRACT

A screw compressor in which a pair of screw rotors supported by bearings and accommodated in a casing act to compress a gas and in which a slide valve disposed between an inner wall of the casing and the pair of screw rotors is capable of moving axially while maintaining a small gap between itself and the outer peripheries of the screw rotors, the rate of gas flow bypassed to an inlet port during compression being regulated by axially moving the slide valve. The screw compressor has: a side cover in which bearing for supporting the pair of screw rotors on the discharge side and a slide valve driving hydraulic means are incorporated and which is disposed on the discharge side of the screw rotors; a discharge axial port formed in the side cover; and at least one projection continuous with an opening edge of the discharge axial port and in contact with a semi-circular surface of the slide valve facing in the radial direction thereof, the projection acting to limit the radial movement of the slide valve while the slide valve is moving in contact with the top end of the projection.

8 Claims, 2 Drawing Sheets

SCREW COMPRESSOR WITH SLIDE VALVE MOVEMENT PREVENTING STRUCTURE

This application is a continuation of application Ser. No. 068,409, filed on July 1, 1987, abandoned.

BACKGROUND OF THE INVENTION

This invention relates to a screw compressor and, more particularly, to a structure which prevents a slide valve from contacting screw rotors.

Details of an example of an ordinary type of screw compressor are disclosed in U.S. Pat. No. 3,088,659, in which, as shown in the accompanying FIG. 3 which illustrates essential parts of this example, a pair of male and female rotors 2 and 3, which compress gas in a casing 1, are accommodated in the casing, and a slide valve 4 which can move axially while maintaining small gaps between itself and the outer peripheries of the rotors 2 and 3 is disposed inside the casing 1, the rate of gas flow bypassed to a gas suction port during compression being regulated by axially moving the slide valve 4.

When, in this type of screw compressor, the slide valve 4 moves in the axial direction, it receives radial forces in response to pressure fluctuations generated between the slide valve 4 and the two rotors. As a result, lip portions 1*a* and 1*b* of the casing 1 are opened by the radial forces and the heat applied to the slide valve 4, and their function restraining the slide valve 4 is thereby lost. The slide valve 4 is therefore brought into contact with the outer peripheral surfaces of the two rotors, and the outer peripheral surfaces of the rotors become worn, thereby causing problems of a reduction in performance and the generation of abnormal noise.

To eliminate these problems, the above patent specifies that a shaft which guides the slide valve is thickened to minimize the extent of movement thereof in the radial direction due to pressure fluctuations. This construction is suitable for a big, large-capacity screw compressor having a comparatively bulky casing, but it is not suitable for a comparatively small screw compressor such as that disclosed in U.S. Pat. No. 3,796,526 in which a motor and screw motor portions are incorporated in one casing. Another possible solution involves a T-shaped guide block which is disposed on the side of the outer circumference of the slide valve, thereby limiting the radial movement of the slide valve. However, it is difficult in practice to manufacture this compressor in terms of the workability and accuracy of the groove into which the guide block must be fitted.

As described above, the conventional known arts cannot consider the workability and accuracy of the fitting groove for the guide block, and it is therefore difficult to work and form the groove to a high enough accuracy to produce the compressor. In a construction in which the guide block is provided as a member which is separate from the casing, the accuracy of the assembled state, such as inclination and/or bending, is reduced, and the guide member is not easy to assemble and cannot be disposed so as to prevent the rotation thereof. Therefore, a compressor of this construction is even more difficult to produce.

SUMMARY OF THE INVENTION

It is therefore an object of the present invention to provide a screw compressor which has an improved workability and accuracy and is capable of preventing the slide valve from contacting the screw rotors by limiting the radial movement of the slide valve by means of a side cover portion where a discharge axial port is formed.

It is another object of the present invention to provide a compact screw compressor in which a motor, a screw compressor and an oil separator are accommodated in one casing.

To this end, the present invention provides a screw compressor having a pair of screw rotors supported by bearings and accommodated in a casing and which compress a gas, and a slide valve which is disposed between an inner wall of the casing and the pair of screw rotors and which can move axially while maintaining a small gap between itself and the outer peripheries of the screw rotors, the rate of gas flow bypassed to an inlet port during compression being regulated by axially moving the slide valve, the screw compressor being characterized by having: a side cover in which bearings for supporting the pair of screw rotors on the discharge side and a slide valve driving hydraulic means are incorporated and which is disposed on the discharge side of the screw rotors; a discharge axial port formed in the side cover; and at least one projection continuous with an opening edge of the discharge axial port and in contact with a semi-circular surface of the slide valve facing in the radial direction thereof, the projection acting to limit the radial movement of the slide valve while the slide valve is moving in contact with the top end of the projection.

Otherwise, the screw compressor in accordance with the present invention is characterized by having: a side cover in which bearings for supporting the pair of screw rotors on the discharge side and a slide valve driving hydraulic means are incorporated and which is disposed on the discharge side of the screw rotors; a discharge axial port formed in the side cover; at least one projection continuous with an opening edge of the discharge axial port and in contact with a semi-circular surface of the slide valve facing in the radial direction thereof, the projection acting to limit the radial movement of the slide valve while the slide valve is moving in contact with the top end of the projection; a cover which covers the side cover and which is attached and fixed to the casing so as to form a discharge chamber communicating with the discharge axial port; a discharge coupling opening formed in and end portion of the cover and connected to a discharge pipe; an oil separating demister disposed in the discharge chamber between the discharge axial port and the discharge coupling opening; a reservoir portion which is formed by extending a casing wall in a lower portion of the casing outside the pair of screw rotors accommodated in the casing and which communicates with a bottom portion of the discharge chamber; a gas inlet opening with a strainer formed in a motor cover disposed on the side of the electric motor; and a terminal for connecting the electric motor to a power source, the terminal being disposed in an upper portion of the casing.

DESCRIPTION OF THE PREFERRED EMBODIMENT

Figure 1:
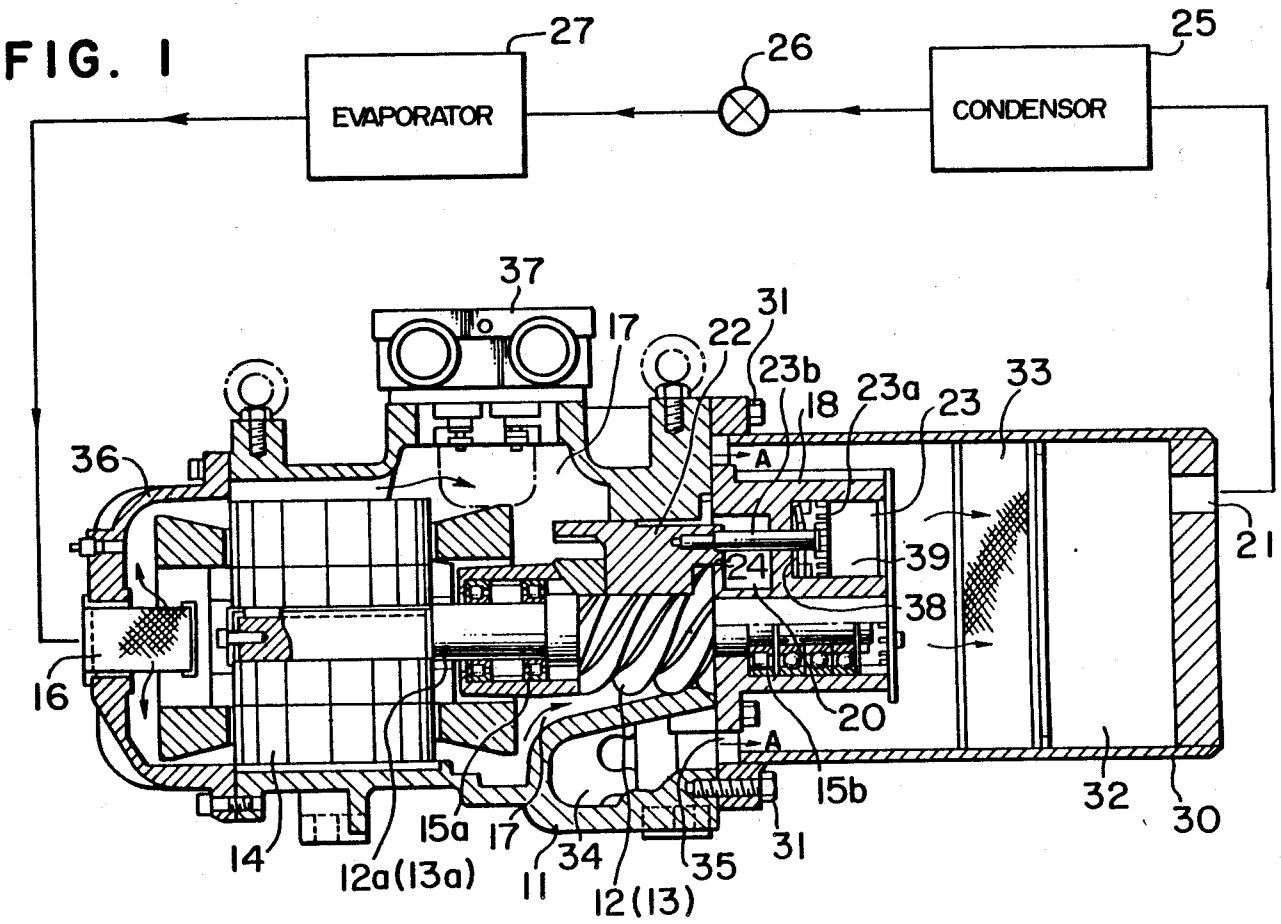
FIG. 1 is a longitudinal cross-sectional view of a screw compressor in accordance with the present invention.
Figure 2:
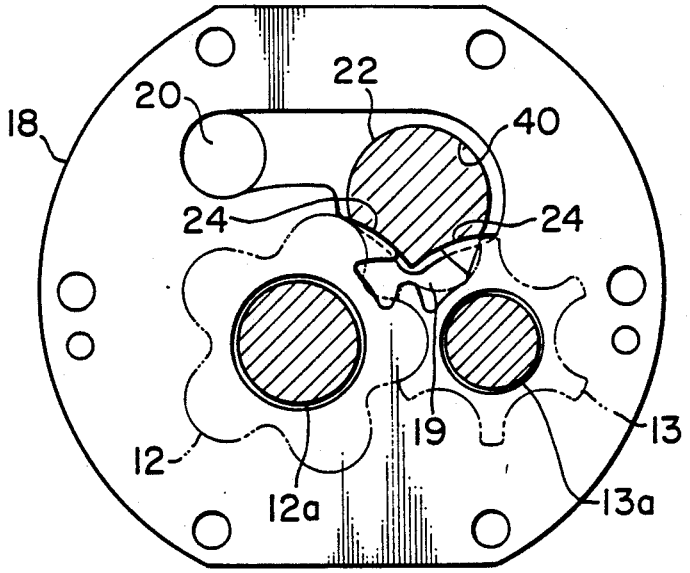
FIG. 2 is a cross-sectional view taken along the line II—II of FIG. 1.
Figure 3:
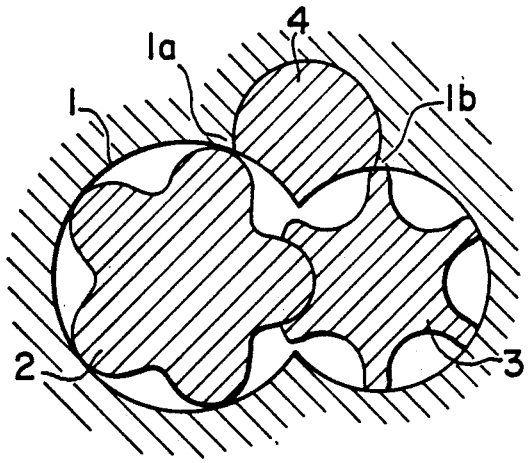
FIG. 3 (PRIOR ART)
FIG. 3 is a transverse cross section of an arrangement of conventional screw rotors and a slide valve.

As shown in FIGS. 1 and 2, a pair of male and female rotors 12 and 13, which rotate in engagement with each other to compress a gas, and a rotor driving electric motor 14 are accommodated in a casing 11. A shaft 12*a* of the male rotor 12 and a shaft 13*a* of the female rotor 13 are supported by bearings 15*a* and 15*b*, respectively, and the shaft 12*a* of the male rotor 12 is directly coupled to the output shaft of the electric motor 14. The interior of the casing 11 is provided with a slide valve 22 which can move axially while maintaining small gaps between itself and the outer peripheral surfaces of the male and female rotors 12 and 13, a hydraulic drive cylinder 23 for moving the slide valve 22, and a piston 23*a*. The slide valve 22 is connected to the left end of a rod 2*b* extending from the piston 23*a* in the hydraulic drive cylinder 23.

Projections 24, which limit the movement of the slide valve 22 in the radial direction, are formed on the discharge-side side cover 18 so as to be continuous with the edge of a discharge axial port 19 and in contact with two semi-circular or arcuate surfaces of the slide valve 22, so that the slide valve 22 moves while being guided by the top ends of the projections 24. A cover 30 is attached and fixed to the end surface of the casing 11 on the discharge side by means of bolts 31, thereby covering the side cover 18. The discharge axial port 19 opens through a discharge port 20 to a discharge chamber 32. An oil separating demister 33 is disposed in the discharge chamber 32 between the discharge axial port 19 and a discharge coupling opening 21, to separate the oil contained in the discharged gas. An oil reservoir portion 34 is formed by extending a casing wall in a lower portion of the casing 11 outside the pair of screw rotors 12 and 13 which are encircled by the casing. The oil reservoir portion 34 communicates with a bottom portion of the discharge chamber 32 through a channel 35. An inlet opening 16 which has a strainer is formed through a motor cover 36 disposed on the casing 11 on the side of the electric motor. A power supply connection terminal portion 37 is disposed on an upper portion of the casing 11. The inlet side of a condenser 25 is connected to the discharge coupling port 21 of the screw compressor by a piping. The inlet side of an expansion valve 26 is connected to the condenser 25 by piping and its outlet side is connected to an evaporator 27 by a piping. The outlet of the evaporator 27 is connected by piping to the inlet opening 16 of the screw compressor.

The male rotor 12 and female rotor 13 are rotated in engagement with each other by the operation of the electric motor 14, thereby compressing a gas which has been drawn through the inlet opening 16 into an inlet port 17. The compressed gas is discharged through the discharge axial port 19 formed in the discharge-side cover 18 to the discharge port 20, and is thereafter sent to the discharge coupling opening 21 and is supplied under pressure to the condenser 25 through the piping. In the condenser 25, the gas is cooled and liquefied by heat exchange with air or water. The liquefied refrigerant is expanded in the expansion valve 26 under reduced pressure to form a low-pressure, low-temperature saturated refrigerant gas, and is then supplied to the evaporator 27. This gas acts to cool air or water in the evaporator 27 during the heat exchange with the air or water. The refrigerant gas which has cooled the air or water is again drawn through the inlet opening 16 to the screw compressor, thus completing a refrigeration cycle.

When a rod chamber 38 of the drive cylinder 23 is supplied with a hydraulic fluid (not shown), the slide valve 22 moves to the right as viewed in FIG. 1, thereby increasing the flow rate of bypassed gas to the inlet port 17 during compression. When a head chamber 39 of the drive cylinder 23 is supplied with the hydraulic fluid, the slide valve moves to the left (to the position indicated in FIG. 1), thereby reducing the flow rate of the bypassed gas to the inlet opening 17 during compression.

The slide valve 22 moves in the axial direction while being guided by the projections 24. That is, the movement of the slide valve 22 in the radial direction is limited by the projections 24 so that the slide valve 22 does not come into contact with the outer peripheral surfaces of the male rotor 12 and the female rotor 13, thereby preventing wear on the pair of rotors and, hence, a reduction in performance and the generation of abnormal noise. In addition, it is possible to form the projections 24 to a high degree of accuracy, since they can be formed by simply working the surface of the cover instead of by forming a groove therein.

A compressor of the 30- to 60-HP class in accordance with this embodiment was manufactured as a trial. It was confirmed that the compressor could prevent a reduction in performance of 3 to 5% and also enabled a reduction in the level of noise by 3 to 5 dB (A scale).

As described above, the present invention provides an arrangement in which projections for limiting the movement of a slide valve in the radial direction are formed in a side cover having a discharge axial port so that the slide valve moves while being guided by the projections. The present invention thereby makes it possible to overcome the difficulty with respect to the workability and the accuracy and positively prevent the slide valve from contacting the screw rotors, thereby eliminating the possibility of reduction in performance and the generation of abnormal noise. The slide valve 22 is connected to the piston 23*a* by the rod 23*b* and is guided by an inner arcuate surface 40 of the casing 11, and the radial movement of the slide valve 22 is limited by the projections 24 which upwardly extend between the guide surface consisting of the arcuate surface of the casing and the slide valve driving means consisting of the piston 23*a* and the cylinder 23, thereby enabling a compact construction around the sliding valve 22 and, hence, reducing the overall size of the screw compressor.

What is claimed is:

1. A screw compressor comprising, a pair of screw rotors supported by bearings and accommodated in a casing to compress a gas, a slide valve disposed between an inner wall of said casing and above said pair of screw rotors so as to move axially while maintaining a small gap between concave surfaces thereof and the outer peripheries of said screw rotors, the rate of gas flow bypassed to an inlet port during compression being regulated by axially moving said slide valve, a side cover in which bearings for supporting said pair of screw rotors on the discharge side and a slide-valve-driving hydraulic means are incorporated and which is disposed on the discharge side of said screw rotors; a discharge axial port formed in said side cover; and projection means continuous with an opening edge of said discharge axial port and in substantial contact over a major portion of the concave surfaces of said slide valve facing in the radial direction thereof for limiting the radial movement of said slide valve while said slide valve is moving in contact with the top of said projection means.

2. A screw compressor according to claim 1, wherein said projection means constitutes two projections contacting a pair of arcuate surfaces of said slide valve.

3. A screw compressor according to claim 1, wherein said slide valve is disposed above said pair of screw rotors and wherein said projecting means are formed so as to be continuous with said opening edge of said axial port and to support said slide valve from below.

4. A screw compressor according to claim 3, wherein the positions of said projecting means are between said slide valve driving hydraulic means and a guide surface formed by an inner arcuate surface of said casing facing said slide valve.

5. A screw compressor according to claim 1, wherein said casing is configured to surround a peripheral portion of said slide valve to prevent lateral movement thereof.

6. A screw compressor comprising a pair of screw rotors supported by bearings and accommodated in a casing to compress a gas, a slide valve disposed between an inner wall of said casing and above said pair of screw rotors so as to move axially while maintaining a small gap between concave surfaces thereof and the outer peripheries of said screw rotors, the rate of gas flow bypassed to an inlet port during compression being regulated by axially moving said slide valve, a side cover in which bearings for supporting said pair of screw rotors on the discharge side and a slide-valve-driving hydraulic means are incorporated and which is disposed on the discharge side of said screw rotors; a discharge axial port formed in said side cover; and projection means continuous with an opening edge of said discharge axial port and in substantial contact over a major portion of the concave surfaces of said slide valve facing in the radial direction thereof for limiting the radial movement of said slide valve while said slide valve is moving in contact with the top of said projection means; a cover which covers said side cover and which is attached and fixed to said casing so as to form a discharge chamber communicating with said discharge axial port; a discharge coupling opening formed in an end portion of said cover and connected to a discharge pipe; an oil separating demister disposed in said discharge chamber between said discharge axial port and said discharge coupling opening; a reservoir portion which is formed by extending a casing wall in a lower portion of said casing outside said pair of screw rotors accommodated in said casing and which communicates with a bottom portion of said discharge chamber; a gas inlet opening with a strainer formed in a cover disposed on said casing; and a terminal for connecting said electric motor to a power source, said terminal being disposed in an upper portion of said casing.

7. A screw compressor according to claim 6, wherein said slide valve and said discharge axial port are disposed above said pair screw rotors and, wherein said inlet port is disposed below said screw rotors.

8. A screw compressor according to claim 6, wherein said casing is configured to surround a peripheral portion of said slide valve to prevent lateral movement thereof.

* * * * *